United States Patent [19]

Lemaitre

[11] Patent Number: 4,527,485

[45] Date of Patent: Jul. 9, 1985

[54] SYSTEM FOR TRANSPORTING HEAVY CYLINDRICAL OBJECTS IN A WORKSHOP

[75] Inventor: René Lemaitre, Gennevilliers, France

[73] Assignee: Les Cables De Lyon, Clichy, France

[21] Appl. No.: 442,330

[22] Filed: Nov. 17, 1982

[30] Foreign Application Priority Data

Nov. 20, 1981 [FR] France ..... 81 21738

[51] Int. Cl.[3] ..... B61B 13/06

[52] U.S. Cl. ..... 104/118; 104/48; 105/141; 198/774; 414/495; 414/911

[58] Field of Search ..... 104/48, 118, 139, 140; 414/495, 910, 911; 198/488, 774; 105/141

[56] References Cited

U.S. PATENT DOCUMENTS

| | | | |
|---|---|---|---|
| 1,004,114 | 9/1911 | Verplanck | 104/48 X |
| 3,075,635 | 1/1963 | Ruppe | 198/774 |
| 3,850,287 | 11/1974 | Petros | 198/774 |
| 4,044,886 | 8/1977 | Sender | 198/774 X |
| 4,106,634 | 8/1978 | Becker | 414/495 |
| 4,131,206 | 12/1978 | Kawada et al. | 414/911 X |
| 4,219,113 | 8/1980 | Fieser et al. | 198/774 |
| 4,236,626 | 12/1980 | Noe | 198/774 X |

FOREIGN PATENT DOCUMENTS

| | | | |
|---|---|---|---|
| 2297176 | 8/1976 | France . | |
| 1437320 | 5/1976 | United Kingdom | 198/774 |
| 1444836 | 8/1976 | United Kingdom . | |

*Primary Examiner*—Randolph Reese

*Attorney, Agent, or Firm*—Sughrue, Mion, Zinn, Macpeak, and Seas

[57] ABSTRACT

A system for transporting heavy cylindrical objects such as cable drums or spools on a carriage guided along a pit dug in the floor includes a channel rail (2) lining the bottom and sides of the pit, a central upstanding rail (3) leaving a longitudinal gap between itself and the channel rail and having a plane top surface (3A) level with the ground. Two longitudinal girders (4A, 4B) integral with the carriage fit into the longitudinal gaps, and the carriage is raised and lowered the longitudinal girders so that they have a high position above floor level for holding a cylindrical object.

2 Claims, 6 Drawing Figures

SYSTEM FOR TRANSPORTING HEAVY CYLINDRICAL OBJECTS IN A WORKSHOP

The present invention relates to a system for transporting heavy cylindrical objects on a carriage in a workshop in which said carriage is guided along a pit formed in the workshop floor.

BACKGROUND OF THE INVENTION

Transport systems of this kind are already known in which the platform of the carriage is level with the floor. Such systems have the disadvantage of being in a pit which constitutes an obstacle for wheeled transport systems. In another respect, if the platform is not fitted with means for holding cylindrical objects to be transported in place, said objects can move sideways off the platform. This danger can be reduced only by limiting the translation speed of the carriage to a very low speed. If, in contrast, the platforms are provided with means such as mouldings or retainer cleats for holding cylindrical objects in place some kind of sill must be negotiated when loading and unloading and this may impose a great effort on the workmen performing the operation; also the load is in danger of falling off the opposite side to that on which it is brought onto the platform of the carriage.

In another system, the carriage has a generally T-shaped cross-section with its vertical webs engaged in a narrow groove cut in the floor and upper surface having a concave middle portion for holding an object to be transported. It is then drawn along by a chain disposed in the guide groove.

Although there is no longer an obstacle to impede loading onto transport devices, there is still a sill to be negotiated when loading and unloading and there is still also the dager of the load falling off the carriage to the opposite side to that on which it is brought onto the carriage.

Preferred embodiments of the invention provide a transport system of the same general nature but which does not have the above drawbacks, which allows wheeled transport systems to cross over its path of travel, and which holds cylindrical objects to be transported efficiently without requiring great physical efforts on loading and on unloading and without danger of said objects falling off from the opposite side to the loading side during transport or at the time of loading.

SUMMARY OF THE INVENTION

The present invention provides a system for transporting heavy cylindrical objects on a carriage in a workshop in which said carriage is guided along a pit formed in the workshop floor, wherein said system includes:

- a channel rail lining the bottom and sides of the pit;
- an upstanding rail which is located in the channel rail symmetrically about the plane of symmetry of the channel rail and which is narrower than the channel rail, thereby leaving a longitudinally extending gap on either side of the upstanding rail between the upstanding rail and the channel rail, the upstanding rail having a plane top surface level with the floor;
- two longitudinal girders integral with the carriage, said girders being sufficiently narrow to be inserted in said longitudinal gaps; and

- means for raising and lowering said longitudinal girders along at least part of their length between a lowered position in which said part of their length is not higher than floor level and a raised position in which said part of their length is above floor level.

The system preferably also has at least one of the following features:

- the longitudinal girders pivot at one of their ends and are connected at their other ends to raising means.
- the raising means are constituted by at least one pneumatic jack.
- the carriage is provided with means which allow it to advance only when the longitudinal girders are in the raised position.
- the carriage is provided with means for controllably stopping its advance at the end of travel at each end of the pit.
- the carriage is provided with carterpillar track rollers which bear against the top edges of the channel rail.

BRIEF DESCRIPTION OF THE DRAWINGS

A system in accordance with the invention for transporting large electric-cable storage drums is described hereinafter by way of example and with reference to the accompanying drawings, in which.

DETAILED DESCRIPTION

Figure 1:
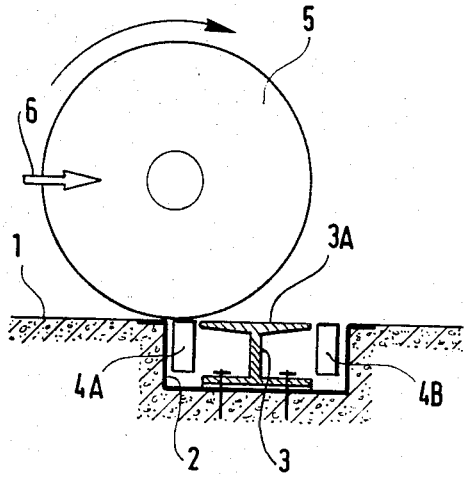
FIG. 1 is a diagrammatic cross-section of the system at a time while a drum is being loaded onto it.

FIG. 1 shows a channel rail 2 running along a pit perpendicular to the plane of the figure in a workshop floor. A raised rail 3 is bolted to the center of the channel rail and leaves two longitudinal spaces, one on each side thereof in which longitudinal girders 4A, 4B of a carriage, indicated generally at C, are housed.

At the time of loading, the longitudinal girders are at a low position, level with the ground. A drum 5 is brought onto the top surface 3A of the rail 3 by a workman rolling it along the workshop floor 1, which operation requires only a small force represented by arrow 6 to be exerted.

Figure 2:
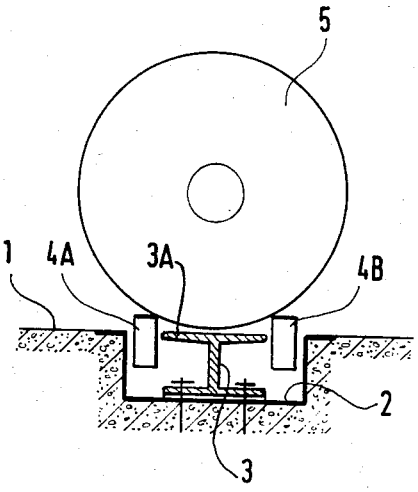
FIG. 2 is a cross-section of the same system with the drum raised by the longitudinal girders.

When the drum is placed on the carriage, C, the longitudinal girders 4A, 4B are raised (FIG. 2) and set the drum in a stable position above the top surface 3A of the rail 3.

Figure 3:
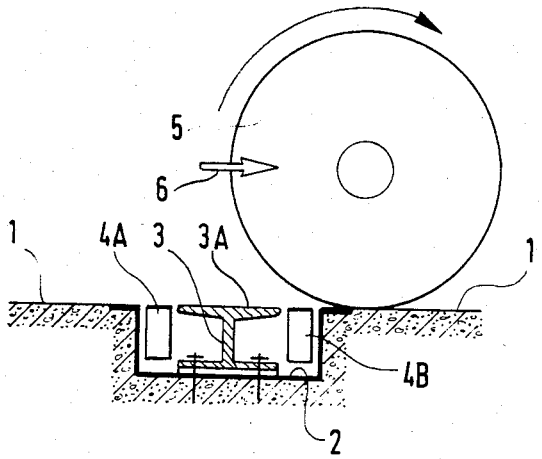
FIG. 3 shows the same system during unloading.

The carriage C is then moved to its destination point where the longitudinal girders are lowered down to ground level. (FIG. 3). The drum 5 is then rolled away by pushing it lightly as represented by the arrow 6, and there is no sill to impede its movement.

Figure 4:
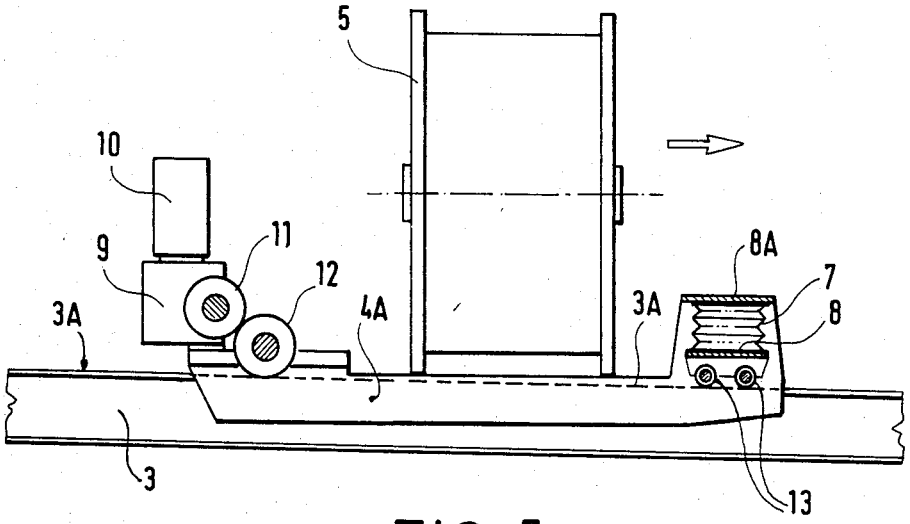
FIG. 4 is a side elevation of the system loaded with a drum, the longitudinal girders being raised by a pneumatic jack.
Figure 5:
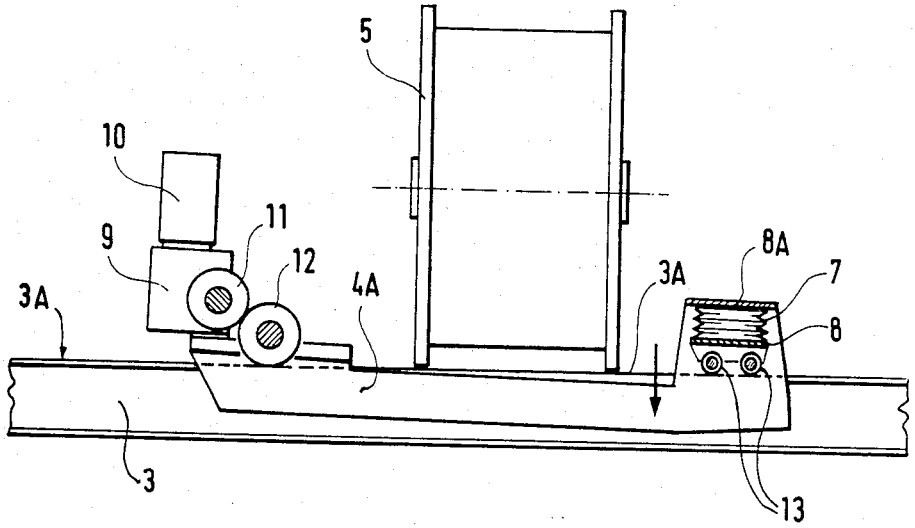
FIG. 5 is a side elevation of the system at the time of loading or unloading, with the pneumatic jack in the lowered position.

FIGS. 4 and 5 are side views showing the operation of a jack which actuates the longitudinal girders and of a mechanism which moves the carriage C. In FIG. 4, a pneumatic jack 7 is in a high position above a stationary member 8 pushing upwards towards a member 8A. The carriage is being moved to the right by an electric motor unit 10 which, via a motor reduction gear 9, drives a gear 11 coupled to drive wheels such as 12 which roll along the floor on either side of the pit. At the front, rollers 13 guide the carriage C.

FIG. 5 shows the pneumatic jack 7 in the lowered position. The longitudinal girders such as 4A are lowered down to floor level underlying the drum 5. The drum 5 can be rolled away along the floor.

Figure 6:
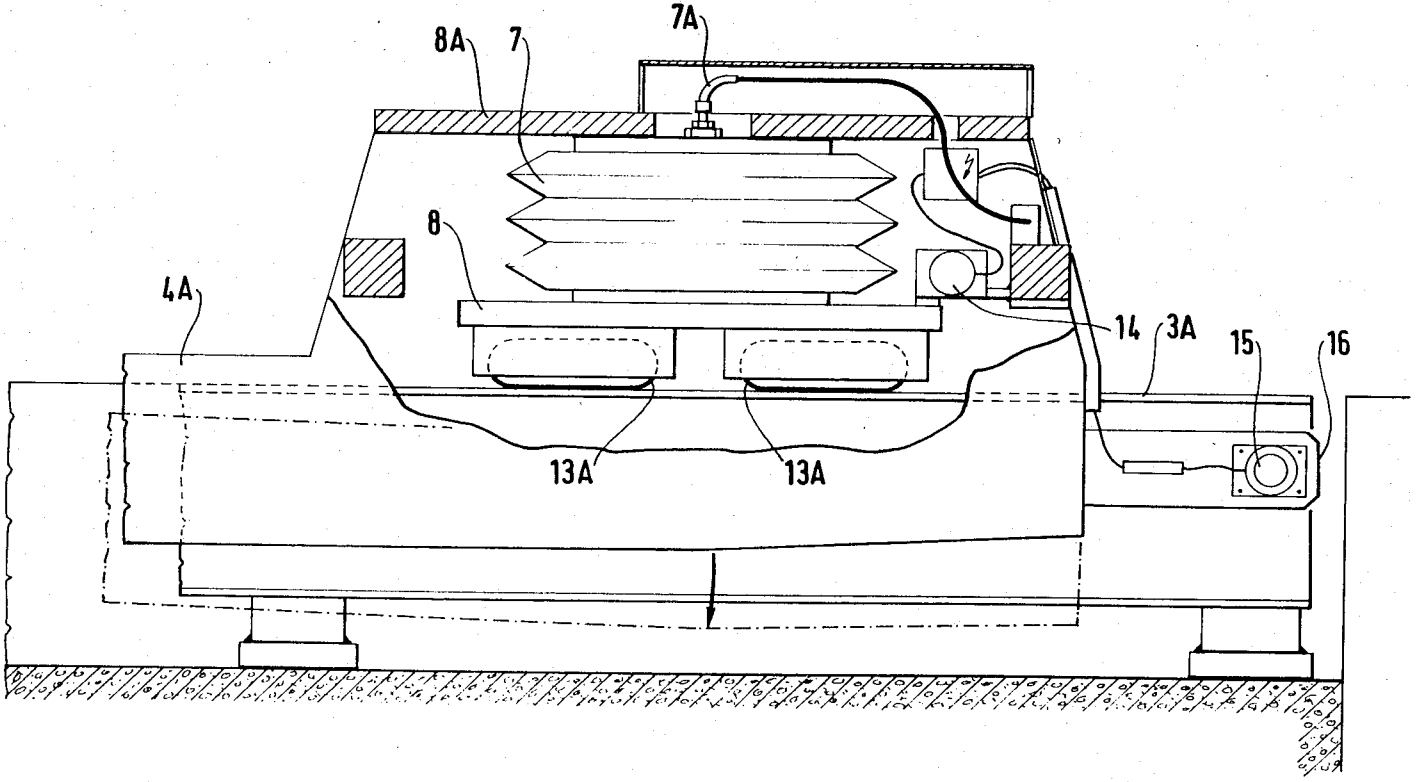
FIG. 6 is a partially cut-away elevation of a portion of a variant system to a larger scale showing a pneumatic jack for controlling the position of the longitudinal girders and position detectors for detecting the position of said longitudinal girders and for detecting the end of travel.

FIG. 6 shows the front part of a carriage C analogous to that shown in FIGS. 4 and 5 but instead of having guide rollers 13, it has caterpillar track rollers 13A whose advantage is that they apply less pressure on the rail 3A than do the guide rollers.

Said carriage C has a pneumatic jack 7 fed by a compressed air supply tube 7A between the stationary plane member 8 and the movable upper member 8A.

A sensor 14 interrupts the power supply circuit to the drive engine when the jack is in the lowered position and thus prevents erroneous operation. At the front of the carriage, a sensor 15 carried by a support 16 detects the arrival of the carriage at the end of its travel and then also cuts the electricity supply to the drive engine.

Of course, the carriage also has at its rear end, behind the chassis of traction engine, an end of travel sensor (not shown) analogous to the sensor 15 which operates on the return of the carriage to its initial position for loading.

Although the transport system which has just been described with reference to the figures of the drawings appears to be the preferred embodiment of the invention, it will be understood that various modifications can be made thereto without going beyond the scope of the invention, it being possible to replace some of its components by others which would perform the same technical function.

In particular, the pneumatic jack could be replaced by a hydraulic jack or by an electric lifting component. Two jacks could be provided instead of one to raise the longitudinal girders by a translation movement instead of by pivoting one end thereof.

The carriage could be moved by means other than an electric motor, e.g. by an internal combustion engine.

The invention applies principally to transporting drums or reels in a workshop, but it is also suitable for transporting cylindrical barrels.

I claim:

1. A system for transporting heavy cylindrical objects on a carriage, said carriage including means for supporting said carriage for longitudinal movement within and guided along a pit formed in the workshop floor, and motor means for driving said carriage along said pit from a loading station to an unloading station, said system including:

a channel rail lining the bottom and side of the pit;

an upstanding rail located within the channel rail symmetrically about the plane of symmetry of the channel rail and being narrower than the channel rail thereby leaving a longitudinally extending gap on either side of the upstanding rail between the upstanding rail and the channel rail, the upstanding rail having a plane top surface level with the floor;

two longitudinal girders integral with the carriage, said girders being narrow and inserted respectively in said longitudinal gaps, said carriage girders being flat; and means for raising and lowering said longitudinal girders along at least a part of their length between lowered position in which said part is no higher than the floor level and a raised position in which said part of their length is above the floor level;

and wherein the longitudinal girders mount drive wheels in contact with the workshop floor at one of their ends forming a pivot axis for the girders at that end, and wherein said means for raising and lowering said carriage includes means connected to the other ends of said girders for raising those ends of said girders relative to the ends mounting said drive wheels;

whereby, with the girders in lowered position, heavy cylindrical objects may be efficiently and easily loaded onto said carraige by rolling them about their axis over a carriage girder with their axis parallel to the girder, while said girders are at raised position, said cylindrical objects may be held onto said carriage without danger of falling off during transport.

2. A system according to claim 1, wherein the carriage is provided with sensing means connected to said means for raising and lowering said longitudinal guides for allowing the carriage to advance only when the longitudinal girders are in the raised position.

* * * * *